US007419935B2

(12) United States Patent
Kadota et al.

(10) Patent No.: US 7,419,935 B2
(45) Date of Patent: Sep. 2, 2008

(54) HEAT-SENSITIVE RECORDING MATERIAL

(75) Inventors: Yasuhiro Kadota, Numazu (JP); Takeshi Kajikawa, Shizuoka (JP); Kunihiko Hada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 352 days.

(21) Appl. No.: 11/375,668

(22) Filed: Mar. 13, 2006

(65) Prior Publication Data

US 2006/0205593 A1 Sep. 14, 2006

(30) Foreign Application Priority Data

Mar. 14, 2005 (JP) ..... 2005-071346

(51) Int. Cl.
*B41M 5/41* (2006.01)
*B41M 5/42* (2006.01)

(52) U.S. Cl. ..... 503/226; 503/200; 503/204; 503/207

(58) Field of Classification Search ..... None
See application file for complete search history.

(56) References Cited

U.S. PATENT DOCUMENTS

| | | | |
|---|---|---|---|
| 4,812,438 | A | 3/1989 | Yamori et al. |
| 5,260,252 | A | 11/1993 | Frangie et al. |
| 5,409,881 | A | 4/1995 | Mori et al. |
| 5,536,697 | A | 7/1996 | Hada et al. |
| 5,646,088 | A | 7/1997 | Hada et al. |
| 5,703,006 | A | 12/1997 | Mori et al. |
| 5,919,729 | A | 7/1999 | Mori et al. |
| 5,972,836 | A | 10/1999 | Morita et al. |
| 6,593,272 | B2 | 7/2003 | Kakuda et al. |
| 6,660,688 | B2 | 12/2003 | Yamada et al. |
| 6,846,619 | B2 | 1/2005 | Kaneko et al. |
| 2004/0171487 | A1 | 9/2004 | Kajikawa et al. |

FOREIGN PATENT DOCUMENTS

| | | | |
|---|---|---|---|
| EP | 0 463 400 | A1 | 1/1992 |
| EP | 0 559 525 | A | 9/1993 |
| EP | 1 114 734 | A | 7/2001 |
| EP | 1 637 324 | A | 3/2006 |
| JP | 62-032080 | A | 2/1987 |
| JP | 01-097679 | A | 4/1989 |
| JP | 01-291981 | A | 11/1989 |
| JP | 02-155688 | A | 6/1990 |
| JP | 06-234270 | A | 8/1994 |
| JP | 2530538 | B | 6/1996 |
| JP | 08-199156 | A | 8/1996 |
| JP | 09-316211 | A | 12/1997 |
| JP | 11-170456 | A | 6/1999 |
| JP | 2000-263935 | A | 9/2000 |
| JP | 2002-248864 | A | 9/2002 |
| JP | 2002-321314 | A | 11/2002 |

*Primary Examiner*—Bruce H Hess
(74) *Attorney, Agent, or Firm*—Cooper & Dunham LLP

(57) ABSTRACT

A heat-sensitive recording material comprising on one surface of a substrate a heat-sensitive coloring layer comprising a leuco dye and a color developer, wherein the heat-sensitive recording material comprises a layer which comprises a copolymer of a (meth)acryloyloxyalkylammonium salt and styrene; and the layer which comprises the copolymer of the (meth)acryloyloxyalkylammonium salt and styrene is at least any one of a back layer, an under layer and a protective layer.

18 Claims, No Drawings

HEAT-SENSITIVE RECORDING MATERIAL

BACKGROUND OF THE INVENTION

1. Field of the Invention

The present invention relates to a heat-sensitive recording material which has an excellent anti-frictional charge property as well as an excellent water resistance and an ability to suppress image-color degradation.

2. Description of the Related Art

A heat-sensitive recording material is a recording material having a structure in which a heat-sensitive coloring layer (hereinafter, also called as 'heat-sensitive recording layer'), where a color is developed by heating, is formed on a substrate such as paper, synthetic paper, and resin film. A thermal printer having a built-in thermal head is used for heating, for the color development.

A method for recording on the heat-sensitive recording material has advantages that it is able to record in a short time by using a comparatively simple apparatus without having a need to perform processes such as developing and fixing as well as its low cost, as compared with other methods for recording. The method for recording on the heat-sensitive recording material is used in many fields: POS field such as perishable foods, boxed meals, and prepared food; copying field such as books and documents; communication field such as facsimile; ticketing field such as ticket vending machines and receipts; and aviation industry such as baggage tags. Among these fields, the method for recording on the heat-sensitive recording material has been used at a rapid pace particularly in POS field for products such as boxed meals and prepared food where hot food is a main selling point as well as for products such as ham which is served cold, and perishable food which is prone to get wet at a low temperature.

In such heat-sensitive recording material, from a view point of properties as recording paper such as dimensional stability, physical strength, and insolubility in water, synthetic paper and plastic film are largely used as a substrate. Particularly, film substrates such as synthetic paper are largely used for applications such as labels for food which is served cold, and baggage tags, and special applications such as labels for sticking on test tubes and beakers used in research laboratories.

However, a film substrate such as synthetic paper has an higher electrical resistance as compared to that of paper, and therefore, static electricity tend to be produced easily due to the friction with components such as a platen roll and a thermal head while running the synthetic paper in a printer during printing. As a result, defects during running such as jamming of the paper and a trouble such as damage of the thermal head tend to occur easily.

Such static electricity is produced mainly by a frictional charge between the platen roll and the heat-sensitive recording material. Therefore, measures such as applying an antistatic agent on a rear surface of the heat-sensitive recording material, which comes in contact with the platen roll, have been taken. Examples of such antistatic agent include: (1) inorganic salts such as sodium chloride, (2) anionic polyelectrolytes such as sodium polystyrenesulfonate, and (3) conductive metallic compounds such as conductive zinc oxide and tin oxide.

However, the inorganic salts such as sodium chloride in (1) and the anionic polyelectrolytes such as sodium polystyrenesulfonate in (2) have a low antistatic effect corresponding to the used amount. In addition, these agents have shortcomings such as being sticky in high humidity and easily dissolved in water.

Moreover, regarding the conductive metallic compounds in (3), although they do not have temperature dependence and show an effect with a minute amount, they have a drawback in terms of chemical safety being used as a heat-sensitive recording material. Particularly, in the fields of POS labels, tags and CAD, various properties such as physical strength against bending and tearing, dimensional stability, and insolubility in water are sought to be satisfied at the same time because of the object of application. However, the above-mentioned compounds are not capable of satisfying sufficiently all these properties.

As a means to solve these problems, heat-sensitive films in which delivery problems of feeding multiple sheets due to static electricity and paper jamming are solved by using a styrene copolymer of an aliphatic quaternary salt in an under layer and a back layer, and which have strong paper-quality strength are proposed (Japanese Patent Application Laid-Open (JP-A) Nos. 62-032080, 01-097679 and 01-291981).

Moreover, JP-A Nos. 06-234270, 2000-263935 and 2002-248864 propose heat-sensitive recording materials in which the trouble during paper delivery and the stickiness are dealt with by providing at least one of the back layer and an under layer which includes one of a polymer of a quaternary salt and an acrylic ester copolymer, and a polymer of a quaternary salt, a water soluble resin, and a water resisting agent as a main component, and further which has excellent water resistance are proposed.

However, in these related arts, a quaternary salt styrene based polymer (a block copolymer of styrene having an aliphatic quaternary ammonium group with a styrene monomer) is used as a quaternary salt polymer. This quaternary salt styrene based polymer has a shortcoming that the density of a print image is degraded during preservation (particularly under high temperature conditions) after printing. The mechanism of this image color degradation has not been clearly known, but it is considered that the quaternary salt styrene based copolymer which is used in the under layer is scattered up to a heat-sensitive coloring layer in a high-temperature environment with easy mass-transfer conditions where a bonding of a leuco dye and a developer is inhibited in some way.

Moreover, such type of color degradation is observed even when the quaternary salt styrene based copolymer is used in the back layer. For example, when the back layer and a front layer (protective layer) come in contact in a rolled form and when samples after printing are stored in piles, the quaternary salt styrene based copolymer comprised in the back layer scatters to the front layer (protective layer) with which the quaternary salt styrene based copolymer is in contact and gives rise to a similar phenomenon of color degradation.

To deal with such image color degradation, the quaternary salt styrene based copolymer, as described in JP-A No. 02-155688, was considered to be a material with which the color degradation cannot occur easily than with other antistatic agents. However, when preservation in a severe environmental conditions such as high temperature conditions and high humidity conditions is taken into consideration, there is still a lacking factor and a further improvement and development is still expected to be done in the present situation.

SUMMARY OF THE INVENTION

An object of the present invention is to provide a heat-sensitive recording material which suppresses image color degradation, has an excellent anti-frictional charge property and a water resistance, and for which an occurrence of a defect during running and a damage of a thermal head is less.

The inventors of the present invention performed studies to solve the issues mentioned above and to obtain a heat-sensitive recording material in which image color degradation does not occur easily even in a severe preservation environment without lowering the anti-frictional charge property and the water resistance. They found that, for achieving the object mentioned above, it was effective the heat-sensitive recording material comprised a layer comprising a copolymer of (meth) acryloyloxyalkylammonium salt and styrene.

The heat-sensitive recording material according to the present invention has a substrate and a heat-sensitive coloring layer which includes a leuco dye and a color developer on one surface of the substrate, and the heat-sensitive recording material has a layer which includes a copolymer of (meth) acryloyloxyalkylammonium salt and styrene.

DESCRIPTION OF THE PREFERRED EMBODIMENTS (Heat-Sensitive Recording Material)

A heat-sensitive recording material according to the present invention has a substrate, a heat-sensitive coloring layer on one surface of the substrate, and a layer which includes a copolymer of styrene and (meth)acryloyloxyalkylammonium salt and additionally other layers, according to the requirement.

<Layer Comprising a Copolymer of (meth)acryloyloxyalkylammonium Salt and Styrene>

The layer including a copolymer of (meth)acryloyloxyalkylammonium salt and styrene includes at least a copolymer of (meth)acryloyloxyalkylammonium salt and styrene, and it further includes additionally other constituents according to the requirement.

—Copolymer of (meth)acryloyloxyalkylammonium Salt and Styrene—

Examples of (meth)acryloyloxyalkylammonium salt in the copolymer of (meth)acryloyloxyalkylammonium salt and styrene include: methacryloyloxyethyltrimethylammonium chloride, acryloyloxyethyltrimethylammonium chloride, methacryloyloxypropylenetrimethylammonium chloride, methacryloyloxyethylene(methyldiethyl)ammonium chloride, methacryloyloxypropylene(methyldiisopropyl)ammonium chloride. Among these acryloyloxyalkylammonium salts, methacryloyloxyethyltrimethylammonium chloride and acryloyloxyethyltrimethylammonium chloride are particularly preferable.

A chemical compound represented by General Formula (1) below is suitable as the copolymer of the (meth)acryloyloxyalkylammonium salt and styrene:

General Formula (1)

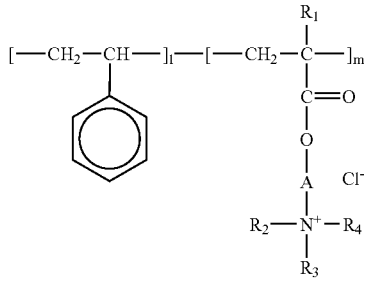

where $R_1$ represents one of hydrogen atom and $CH_3$. $R_2$, $R_3$, and $R_4$ may be mutually identical or may be different, and they represent any one of $CH_3$ and $C_2H_5$. A represents —$(CH_2)_n$— where n is one to three. Each of l and m represents an integer from one to 100.

It is preferable that the content of the copolymer of the (meth)acryloyloxyalkylammonium salt and styrene in the layer which includes the copolymer is 5% by mass to 40% by mass, and 15% by mass to 30% by mass is more preferable. When the content is less than 5% by mass, there is a possibility that the antistatic performance is insufficient. When the content is more than 40% by mass, there is a possibility that the stability as a coating solution reduces.

It is necessary that the heat-sensitive recording material has at least one layer including a copolymer of the (meth)acryloyloxyalkylammonium salt and styrene. For example, the layer is preferably at least any one of a back layer on the surface of a substrate opposite to the side having a heat-sensitive coloring layer, an under layer between the substrate and the heat-sensitive coloring layer, and a protective layer on the heat-sensitive coloring layer. It is particularly preferable that all of the back layer, the under layer, and the protective layer include the copolymer of the (meth)acryloyloxyalkylammonium salt and styrene.

Moreover, from a practical aspect, it is preferable that at least one of the back layer and the under layer includes the copolymer of the (meth)acryloyloxyalkylammonium salt and styrene and that at least the back layer includes the copolymer of the (meth)acryloyloxyalkylammonium salt and styrene.

<Back Layer>

The back layer includes, apart from the copolymer of the (meth)acryloyloxyalkylammonium salt and styrene, a binder resin, and other constituents according to the requirement.

—Binder Resin—

Any of a water dispersible resin and a water soluble resin can be used as the binder resin. Hitherto known water soluble high polymers and aqueous high polymer emulsions are specific examples.

Examples of the water soluble high polymer include: polyvinyl alcohols, starch and derivatives of starch, cellulose derivatives such as methoxy cellulose, hydroxyethyl cellulose, carboxymethyl cellulose, methyl cellulose, ethyl cellulose, sodium polyacrylate, polyvinyl pyrrolidine, copolymers of acrylamide/acrylic esters, terpolymers of acrylamide/acrylic ester/methacrylic acid, styrene/anhydrous maleic copolymer alkali salts, isobutylene/anhydrous maleic copolymer alkali salts, polyacrylamides, sodium alginate, gelatin, and casein. Each of these water soluble high polymers may be used alone or in combination.

Examples of the aqueous high polymer emulsion include latexes such as acrylic ester copolymers, styrene/butadiene copolymers, and emulsions such as polyvinyl acetate resins of styrene/butadiene/acrylic copolymers, polyvinyl acetate/acrylic acid copolymers, styrene/acrylic ester copolymers, acrylic ester resins, and polyurethane resins. These aqueous high polymers may be used alone or in combination.

Among these binder resins, acrylic ester copolymers and polyvinyl alcohol are particularly preferable.

It is preferable that the back layer additionally includes a water resisting agent according to the requirement. Examples of the water resisting agent include formalin, glyoxal, chrome alum, melamine resins, melamine-formalin resins, polyamides, polyamide-epichlorohydrin resins, and hydrazine hydrozide compounds.

Moreover, the back layer may also include a filler such as inorganic filler and organic filler, surfactant, hot-melt substance, lubricant and other auxiliaries according to the requirement in the back layer.

The method of forming the back layer is not restricted and can be selected appropriately according to the object. However, a method for forming the back layer by applying a back layer coating solution on a substrate is suitable.

The coating method is not restricted and can be selected appropriately according to the object, and examples of the method for applying include a blade coating method, a gravure coating method, a gravure offset coating method, a bar coating method, a roll coating method, a knife coating method, an air knife coating method, a comma coating method, a U-comma coating method, an AKKU coating method, a smoothing coating method, a micro gravure coating method, a reverse roll coating method, a 4-roll or 5-roll coating method, a dip coating method, a curtain coating method, a slide coating method and a die coating method.

After applying the back layer coating solution, the back layer may be allowed to dry. The temperature for drying the back layer is not restricted and can be selected appropriately according to the requirement. However, the temperature is preferably 30° C. to 250° C.

The amount deposited on the back layer after drying is preferably 0.1 g/m$^2$ to 4.0 g/m$^2$, and more preferably 0.2 g/m$^2$ to 3.0 g/m$^2$. When the amount deposited is less, an antistatic effect is low. On the other hand, when the amount deposited is more, the antistatic effect is high. However, problems occur such as reduction in binding capability as well as solubility with respect to water and background fog in the heat-sensitive coloring layer.

<Under Layer>

The under layer may be formed with materials, a means and a coating method similar to those given as a forming method of the back layer. In addition, the under layer may also include, apart from the copolymer of the (meth)acryloyloxyalkylammonium salt and styrene, plastic hollow particles having a hollow ratio of 50% or more, and it further includes a binder resin and other constituents according to the requirement.

Moreover, the following aspects are preferable: (1) the copolymer of the (meth)acryloyloxyalkylammonium salt and styrene and the plastic hollow particles having a hollow ratio of 50% or more are used in a single under layer; and (2) a first under layer includes the plastic hollow particles having a hollow ratio of 50% and more is provided on the substrate and then a second under layer including the copolymer of the (meth)acryloyloxyalkylammonium salt and styrene is provided on the first under layer.

In this case, the hollow ratio means a ratio of the outer diameter and the inner diameter of a hollow particle and is represented by the following Formula (1):

$$\text{Hollow ratio (\%)} = [(\text{inner diameter of hollow particle})/(\text{outer diameter of hollow particle}) \times 100 \qquad \text{Formula (1)}$$

The plastic hollow particles are particles which have thermoplastic resin as a shell, and examples of the thermoplastic resin include polystyrene, polyvinyl chloride, polyvinylidene chloride, polyvinyl acetate, polyacrylic ester, polyacrylic nitrile, and polybutadiene, and copolymer resins thereof. Among these resins, the copolymer resins which have vinylidene chloride and acrylic nitrile as main constituent are particularly preferable.

Moreover, the average particle diameter of the plastic hollow particles is preferably 0.4 μm to 10 μm, and more preferably 1.0 μm to 5.0 μm.

When the average diameter of the particles (outer diameter of the particles) is less than 0.4 μm, there are problems in manufacturing that it is difficult to obtain hollow particles with desired hollow ratio. When the average diameter is more than 10 μm, there is degradation in terms of the adhesive strength with the thermal head, an effect of improvement in sensitivity and definition due to the reduction in the smoothness of a surface after applying the layer.

Therefore, it is preferable that a particle distribution has the particle size in the range mentioned above as well as a uniform distribution peak with less variation.

The binder resin is not restricted and can be selected appropriately from hitherto known water soluble high polymers and aqueous high polymer emulsions. Examples thereof include polyvinyl alcohols, starch and derivatives of starch, the cellulose derivatives such as methoxy cellulose, hydroxyethyl cellulose, carboxymethyl cellulose, methyl cellulose, and ethyl cellulose, sodium polyacrylate, polyvinyl pyrrolidine, copolymers of acrylamide-acrylic ester, terpolymers of acrylamide-acrylic ester-methacrylic acid, styrene-anhydrous maleic copolymer alkali salts, isobutylene-anhydrous maleic copolymer alkali salts, polyacrylamide, sodium alginate, gelatin, and casein.

Moreover, examples of the aqueous high polymer emulsion include latexes such as styrene-butadiene copolymers and styrene-butadiene-acrylic copolymers; and emulsions such as vinyl acetate resins, vinyl acetate-acrylic acid copolymers, styrene-acrylic ester copolymers, acrylic ester resins, and polyurethane resins.

A method of forming the under layer is not restricted and can be selected appropriately according to the object, and a suitable method of forming the under layer is by applying an under layer coating solution on a substrate.

The coating method is not restricted and can be selected appropriately according to the object, and examples thereof include a blade coating method, a gravure coating method, a gravure offset coating method, a bar coating method, a roll coating method, a knife coating method, an air knife coating method, a comma coating method, a U-comma coating method, an AKKU coating method, a smoothing coating method, a micro gravure coating method, a reverse roll coating method, a 4-roll or 5-roll coating method, a dip coating method, a curtain coating method, a slide coating method and a die coating method.

After applying the under layer coating solution, the under layer may be allowed to dry. The temperature for drying the under layer is not restricted and can be selected appropriately according to the requirement. However, the temperature is preferably 30° C. to 250° C.

The deposited amount of the under layer after drying is preferably in a range of 0.2 g/m$^2$ to 10 g/m$^2$, and more preferably a range of 0.4 g/m$^2$ to 5 g/m$^2$.

<Protective Layer>

The protective layer comprises, apart from the copolymer of the (meth)acryloyloxyalkylammonium salt and styrene, a binder resin, a cross-linking agent and a filler.

The binder resin is not restricted and can be selected appropriately according to the object. However, a water soluble resin is preferable. Examples of the water soluble resin include polyvinyl alcohols, starch and derivatives of starch, the cellulose derivatives such as methoxy cellulose, hydroxyethyl cellulose, carboxymethyl cellulose, methyl cellulose, and ethyl cellulose, sodium polyacrylate, polyvinyl pyrrolidine, copolymers of acrylamide-acrylic ester, terpolymers of acrylamide-acrylic ester-methacrylic acid, styrene-anhydrous maleic copolymer alkali salts, isobutylene-anhydrous maleic copolymer alkali salts, polyacrylamide, modified polyacrylamides, methylvinylether-anhydrous maleic copolymers, carboxy modified polyethylene, polyvinyl alcohol-acrylamide block copolymers, melamine-formaldehyde resins, urea-formaldehyde resins, sodium alginate, gelatin, and casein. Among these water soluble resins, polyvinyl alcohol is preferable, and diacetone polyvinyl alcohol is particularly preferable.

Regarding the cross-linking agent (or hardening agent), it is not restricted as long as it reacts with the water soluble resin, and any cross-linking agent which reduces the solubility of the water soluble resin in water can be used appropriately according to the object. Examples of the cross-linking agent include glyoxal derivatives, methylol derivatives, epichlorohydrin derivatives, epoxy compounds, azilidine compounds, hydrazines, and hydrazide derivatives.

As a combination of the water soluble resin and the cross-linking agent, the preferable aspects are as follows: an aspect in which the water soluble resin is an itaconic acid modified polyvinyl alcohol and the cross-linking agent is a polyamide epichlorohydrin resin; and an aspect in which the water soluble resin is diacetone modified polyvinyl alcohol and the cross-linking agent is an adipic acid dihydrazide.

—Filler—

Examples of the filler include silicates such as silica, calcium silicate, magnesium silicate, aluminum silicate, zinc silicate, and amorphous silica, inorganic pigments such as zinc oxide, aluminum oxide, titanium dioxide, aluminum hydroxide, barium sulfate, talc, clay, magnesium oxide, magnesium hydroxide, calcium carbonate, and magnesium carbonate, and organic pigments such as nylon resin filler, urea-formalin resin filler, and raw starch particles.

The protective layer may include, apart from the constituents mentioned above, a surfactant, a lubricant, and a loading material in combination. Examples of the lubricant include higher fatty acids and metal salts thereof higher fatty acid amides, higher fatty acid esters, animal wax, vegetable wax, mineral wax, and petroleum wax.

Examples of the loading material include inorganic fine powders such as calcium carbonate, silica, zinc oxide, titanium oxide, aluminum hydroxide, zinc hydroxide, barium sulfate, clay, kaolin, talc, and calcium and silica subjected to surface treatment, and moreover, organic fine powders such as urea-formalin resins, styrene/methacrylic copolymers, polystyrene resins, and vinylidene chloride resins.

A method of forming the protective layer is not restricted and can be formed by any hitherto known coating method. Examples of the coating method include a blade coating method, a comma coating method, a U-comma coating method, an AKKU coating method, a smoothing coating method, a micro gravure coating method, a reverse roll coating method, a 4-roll or 5-roll coating method, a dip coating method, a curtain coating method, a slide coating method, and a die-coating method.

The amount of the protective layer deposited is 5 $g/m^2$ or less. When the amount deposited is more than 5 $g/m^2$, it causes a degradation of color-developing sensitivity.

<Heat-Sensitive Coloring Layer>

The heat-sensitive coloring layer includes a leuco dye and a color developer. The heat-sensitive coloring layer further includes a binder resin and other constituents according to the requirement.

—Leuco Dye—

The leuco dye is not restricted and can be selected appropriately according to the requirement from dyes which are normally used for heat-sensitive recording materials. Examples of the leuco dye include dyes such as triphenylmethane, fluoran, phenothiazine, auramine, spiropyrane and indolinophthalide.

Specific examples of the leuco dye include 2-anilino-3-methyl-6-dibutylaminofluoran, 2-anilino-3-methyl-6-dipentylaminofluoran, 2-anilino-3-methyl-6-[ethyl(4-methylphenyl)amino]fluoran, 3,3-bis(p-dimethylaminophenyl)-phthalide, 3,3-bis(dimethylaminophenyl)-6-dimethylaminophthalide (also known as Crystal Violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-(N-methyl-N-isobutyl)-6-methyl-7-anilinofluoran, 3-(N-ethyl-N-isoamyl)-6-methyl-7-anilinofluoran, 3-diethylamino-7-chlorofluoran, 3-diethylamino-7-methylfluoran, 3-diethylamino-7,8-benzofluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl)amino}-6-diethylaminofluoran, 2-{3,6-bis(diethylamino)-9-(o-chloroanilino)xanthyl benzoic acid lactam, 3-diethylamino-6-methyl-7-(o-chloroanilino)fluoran, 3-dibutylamino-7-(o-chloroanilino)fluoran, 3-(N-methyl-N-amylamino)-6-methyl-7-anilinofluoran, 3-(N-methyl-N-cyclohexylamino)-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, benzoyl leuco methylene blue, 6'-chloro-8'methoxy-benzoindolino-spiropyran, 6'-bromo-3'-methoxy-benzoindolino-spiropyran, 3-(2'-hydroxy-4'-dimethylaminophenyl-3-(2'-methoxy-5'-chlorophenyl)phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-α-phenylethylamino)fluoran, 3-diethylamino-7-(o-methoxycarbonylphenylamino)fluoran, 3-diethylamino-5-methyl-7-α-phenylethylamino)fluoran, 3-diethylamino-7-piperidinofluoran, 2-chloro-3-(N-methyl-toluidino)-7-(p-n-butylanilino)fluoran, 3-(N-methyl-N-isopropylamino)-6-methyl-7-anilinofluoran, 3-dibutylamino-6-methyl-7-anilinofluoran, 3,6-bis(dimethylamine) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-{N-ethyl-N-(2-ethoxypropyl)amino}-6-methyl-7-anilinofluoran, 3-{N-ethyl-N-tetrahydrofurfurylamino}-6-methyl-7-anilinofluoran, 3-diethylamino-6-methyl-7-mesidiono-4',5'-benzofluoran, 3-(p-dimethylaminophenyl)-3-{1,1-bis(p-dimethylaminophenyl)ethylene-2-yl)phthalide, 3-(p-dimethylaminophenyl)-3-{1,1-bis(p-dimethylaminopheny)ethylene-2-yl}-6-dimethylaminophthalide, 3-(p-dimethylaminophenyl)-3-(1-p-dimethylaminophenyl-1-phenylethylene-2-yl)phthalide, 3-(p-dimethylaminophenyl)-3-(1-p-dimethylaminophenyl-1-p-chlorophenylethylene-2-yl)-6-dimethylaminophthalide, 3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl) benzophthalide, 3-dimethylamino-6-dimethylamino-fluorene-9-spiro-3'(6'-dimethylamino)phthalide, 3,3-bis{2-

(p-dimethylaminophenyl)-2-(p-methoxyphenyl)ethenyl}-4,5,6,7-tetrachlorophthalide, 3-bis{1,1-bis(4-pyrrolidinophenyl)ethylene-2-yl}-5,6-dichloro-4,7-dibromophthalide, bis(p-dimethylaminostyryl)-1-naphthalenesulfonylmethane, and bis(p-dimethylaminostyryl)-1-p-tolylsulfonylmethane. These may be used alone or in combination.

The amount of the leuco dye in the heat-sensitive coloring layer is preferably 5% by mass to 30% by mass, and more preferably 8% by mass to 20% by mass.

diphenolsulfone, antipyrine complexes of α,α-bis(4-hydroxyphenyl)-α-methyltoluenethiocyanic acid, tetrabromobisphenol A, tetrabromobisphenol S, 4,4'-thiobis(2-methylphenol), 3,4-hydroxy-4'-methyl-diphenylsulfone, and 4,4'-thiobis(2-chlorophenol), N-p-tolylsulfonyl-N'phenylurea, N-p-toluenesulfonyl-N'-3-(p-toluenesulfonyloxy)phenylurea, a diphenyl sulfone derivative represented by General Formula (2) below, and a urea-urethane compound derivative represented by General Formula (3) below. These color developers can be used alone or in combination.

General Formula (2)

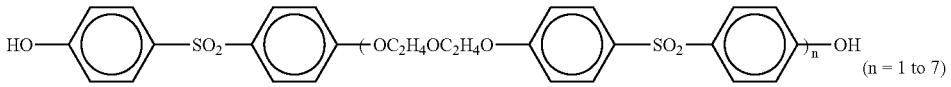

General Formula (3)

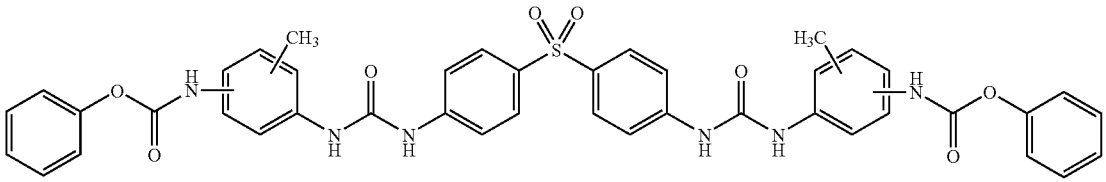

—Color Developer—

The color developer is not restricted and can be selected appropriately according to the requirement from any hitherto known electron accepting compounds, and example of the color developer are phenolic compounds, thiophenolic compounds, thiourea derivatives, organic acids, and metal salts of organic acids.

Specific examples of the color developer include 4,4'-isopropylidenebisphenol, 3,4'-isopropylidenebisphenol, 4,4'-isopropylidenebis(o-methylphenol), 4,4'-secondary-butylidenebisphenol, 4,4'-isopropylidenebis(o-tertiary-butylphenol), 4,4'-cyclohexylidenediphenol, 4,4'-isopropylidenebis(2-chlorophenol), 2,2'-methylenebis(4-methyl-6-tertiary-butylphenol), 2,2'-methylenebis(4-ethyl-6-tertiary-butylphenol), 4,4'-butylidenebis(6-tertiary-butyl-2-methy)phenol, 1,1,3-tris(2-methyl-4-hydroxy-5-tertiary-butylphenol)butane, 1,1,3-tris(2-methyl-4-hydroxy-5-cyclohexylphenyl)butane, 4,4'-thiobis(6-tertiary-butyl-2-methyl)phenol, 4,4'-diphenolsulfone, 4,2'-diphenolsulfone, 4-isopropoxy-4'-hydroxydiphenylsulfone, 4-hydroxy-4'-allyloxydiphenylsulfone, 4-benzyloxy-4'-hydroxydiphenylsulfone, 4,4'-diphenolsulfoxide, P-hydroxybenzoic acid isopropyl, P-hydroxybenzoic acid benzyl, benzyl protocatechuate, stearyl gallate, lauryl gallate, octyl gallate, 1,7-bis(4-hydroxyphenylthio)-3,5-dioxaheptane, 1,5-bis(4-hydroxyphenylthio)-3-oxaheptane, 1,3-bis(4-hydroxyphenylthio)-propane, 2,2'-methylenebis(4-ethyl-6-tertiarybutylphenol), 1,3-bis(4-hydroxyphenylthio)-2-hydroxypropane, N,N'-diphenylthiourea, N,N'-di(m-chlorophenyl)thiourea, salicylanilide, 5-chlorosalicylanilide, salicyl-o-chloroanilide, 2-hydroxy-3-naphthoic acid, antipyrine complexes of zinc thiocyanate, zinc salt of 2-acetyloxy-3-naphthoic acid, 2-hydroxy-1-naphthoic acid, 1-hydroxy-2-naphthoic acid, metal salts of hydroxy naphthoic acid with metals such as zinc, aluminum, a calcium, bis-(4-hydroxyphenyl)methylester acetate, bis-(4-hydroxyphenyl)benzylester acetate, 4-{β-(p-methoxyphenoxy)ethoxy}salicylic acid, 1,3-bis(4-hydroxycumyl)benzene, 1,4-bis(4-hydroxycumyl)benzene, 2,4'-diphenolsulfone, 3,3'-diallyl-4,4'-

The amount of the color developer to be added to the heat-sensitive coloring layer is not restricted and can be selected appropriately according to the requirement. The amount of the color developer to be added to the heat-sensitive coloring layer is preferably one part by mass to 20 parts by mass for one part by mass of a coloring agent, and more preferably two parts by mass to 10 parts by mass.

The binder resin is not restricted and can be selected appropriately from hitherto known resins according to the requirement. Examples of the binder resin include water soluble high polymers such as polyvinyl alcohols, starch and derivatives of starch, cellulose derivatives such as methoxy cellulose, hydroxyethyl cellulose, carboxymethyl cellulose, methyl cellulose, ethyl cellulose, sodium polyacrylate, polyvinyl pyrrolidine, copolymers of acrylamide-acrylic ester, terpolymers of acrylamide-acrylic ester-methacrylic acid, styrene-anhydrous maleic copolymer alkali salts, isobutyl-anhydrous maleic copolymer alkali salts, polyacrylamides, sodium alginate, gelatin, and casein, and apart from such water soluble high polymer, examples further include emulsions such as polyvinyl alcohol, polyurethane, polyacrylic acid, polyacrylic ester, polymethacrylic ester, polybutyl methacrylate, copolymers of vinyl chloride-vinyl acetate, and copolymers of ethylenevinyl acetate, and latexes such as styrene-butadiene copolymers and styrene-butadiene-acrylic copolymers. These may be used alone or in combination.

Various hot-melt substances can be used as a sensitivity improving agent in the heat-sensitive coloring layer. Examples of the hot-melt substance include fatty acids such as stearic acid and behenic acid, fatty acid amides such as stearic acid amide and palmitic acid amide, metal salts of fatty acid such as zinc stearate, aluminum stearate, calcium stearate, zinc palmitate, and zinc behenate, p-benzylbiphenyl, terphenyl, triphenylmethane, p-benzyloxybenzoic acid benzyl, β-benzyloxynaphthalene, β-naphthoic acid phenylester, 1-hydroxy-2-naphthoic acid phenylester, 1-hydroxy-2-naphthoic acid methylester, diphenylcarbonate, terephthalic acid dibenzylester, terephthalic acid dimethylester, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibezyldisulfide, 1,1-diphenylethanol, 1,1-diphenylpropanol, p-(benzyloxy)benzyl alcohol, 1,3-diphenoxy-2-propanol, N-octadecylcarbamoyl-p-methoxycarbonylbenzene, N-octadecylcarbamoylbenzene, oxalic acid dibenzyl ester, and 1,5-bis(p-methoxyphenyloxy)-3-oxapentane. These can be used alone or in combination.

The heat-sensitive coloring layer may include various auxiliary additive constituents such as surfactant, lubricant and loading material according to the requirement. Examples of the lubricant include higher fatty acids or metal salts thereof higher fatty acid amides, higher fatty acid esters, animal wax, vegetable wax, mineral wax, and petroleum wax.

Examples of the loading material include inorganic fine powders such as calcium carbonate, silica, zinc oxide, titanium oxide, aluminum hydroxide, zinc hydroxide, barium sulfate, clay, kaolin, talc, and calcium and silica subjected to surface treatment, and moreover, include organic fine powders such as urea-formalin resins, styrene/methacrylic copolymers, polystyrene resins, and vinylidene chloride resins.

A method of forming the heat-sensitive coloring layer is not restricted and can be formed by any normally known method. The heat-sensitive coloring layer can be formed, for example, by the following procedure: a leuco dye and a color developer are pulverized and dispersed separately with a bonding agent and other constituents in a disperser such as ball mill, attritor mill and sand mill until the diameter of the dispersed particles is 0.1 μM to 3 μm; a heat-sensitive coloring layer coating solution is prepared by mixing the mixture according to a prescribed recipe with a dispersant of a loading material, a hot-melt substance (sensitizer) dispersion; the heat-sensitive coloring layer is formed by applying the heat-sensitive coloring coating solution on the substrate.

The deposited amount of the heat-sensitive coloring layer varies depending on the composition of the heat-sensitive coloring layer and the application of the heat-sensitive adhesive material and cannot be stipulated categorically. The deposited amount of the heat-sensitive coloring layer is preferably 1 $g/m^2$ to 20 $g/m^2$, and more preferably 3 $g/m^2$ to 10 $g/m^2$.

The heat-sensitive recording material according to the present invention shows remarkable improvement in terms of adhesion to a thermal head by means of calendering, and it is extremely preferable that the calendering process is performed on the under layer, the heat-sensitive coloring layer, or the protective layer. Controlling the smoothness of the surface through the magnitude of the calendering pressure on the under layer, the heat-sensitive coloring layer or the protective layer eliminates the background fog and furthermore provides a heat-sensitive recording material with higher definition than conventional equivalents.

<Substrate>

There is no restriction on the form, the structure, and the size of the substrate; the shape, the structure, and the size of the substrate can be selected appropriately according to the requirement. Examples of the form include a sheet form, a roll form and a flat plate form, the structure may be one of a single layered structure and a laminated layered structure, and the size of the substrate can be selected appropriately according to the size of the heat-sensitive recording material.

The present invention, in particular, is produced for the purpose of preventing the static charge which is developed when a plastic film and a synthetic paper film are used for the substrate. However, the substrate used in the present invention is not restricted to the synthetic paper film and the plastic film; high-quality paper, recycled paper, single-sided glazed paper, oil-resistant paper, coated paper, art paper, cast-coated paper, light-weight coated paper and resin-laminated paper can be used for the substrate.

The thickness of the substrate is not restricted and can be selected appropriately according to the object. The thickness is preferably 30 μm to 2,000 μm, and more preferably 50 μm to 1,000 μm.

<Heat-Sensitive Recording Label>

A heat-sensitive recording label as the heat-sensitive recording material according to the first aspect includes an adhesive layer on the rear surface of the substrate on a side opposite to the heat-sensitive coloring layer, a release paper on the surface of the adhesive layer, and other composition according to the requirement. Further, the heat-sensitive recording label includes a back layer surface on the rear surface.

A material of the adhesive layer is not restricted and can be selected appropriately according to the object. Examples thereof include urea resins, melamine resins, phenolic resins, epoxy resins, polyvinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic ester copolymers, methacrylic ester copolymers, natural rubbers, cyanoacrylate resins, and silicone resins. These resins and copolymers can be used alone or in combination.

The heat-sensitive recording label according to the second aspect includes a heat-sensitive adhesive layer, which develops adhesion when heated, on the rear surface of the substrate on a side opposite to the heat-sensitive coloring layer and other composition according to the requirement. Further, the heat-sensitive recording label includes a back layer surface on the rear surface.

The heat-sensitive adhesive layer includes a thermoplastic resin and a hot-melt substance. The heat-sensitive adhesive layer further includes a tackifier according to the requirement. The thermoplastic resin imparts tackiness and adhesion to the heat-sensitive adhesive layer. The hot-melt substance does not impart thermoplasticity to resins since it is solid at a room temperature. However, the hot-melt substance is fused by heating, and the resin is allowed to be swollen or be softened so as to impart tackiness. Moreover, the tackifier has a function of improving the tackiness.

<Heat-Sensitive Recording Magnetic Paper>

A heat-sensitive recording magnetic paper as the heat-sensitive recording material includes a magnetic recording layer on the rear surface of the substrate on the side opposite to the heat-sensitive coloring layer and other composition according to the requirement. Further, the heat-sensitive recording magnetic paper includes a back layer surface on the rear surface.

The magnetic recording layer is formed by coating on the substrate with materials such as iron oxide and barium ferrite and a resin such as vinyl chloride, urethane resin and nylon resin, or it is formed by chemical deposition or sputtering without using a resin.

It is preferable that the magnetic recording layer is provided on the surface of the substrate on the side opposite to the heat-sensitive coloring layer. However, the magnetic recording layer may also be provided on a part of the heat-sensitive coloring layer between the substrate and the heat-sensitive coloring layer.

The form of the heat-sensitive recording material according to the present invention is not restricted and can be selected appropriately according to the requirement. Examples of the appropriate form include a label, a sheet, and a roll.

A recording method using the heat-sensitive recording material according to the present invention is not restricted, and a recording can be performed by a hot pen, a thermal head, and a laser heating, according to the object.

The heat-sensitive recording material according to the present invention can be used favorably in various fields: POS field such as perishable food, boxed meals and prepared food; copying field such as books and documents; communication field such as facsimile; ticketing field such as ticket vending machines and receipts; baggage tags in aviation industry.

The present invention will be described below further specifically with Examples and Comparative Examples. However, the present invention is not restricted to Examples and Comparative Examples described below. Parts and percentage shown below are mass based.

<Preparation of Solution A (Leuco Dye Dispersion)>

A leuco dye dispersion was prepare by pulverization followed by dispersion of the following composition with a sand mill such that the average particle diameter was 0.6 μm.

3-dibutylamino-6-methyl-7-anilinofluoran . . . 20 parts
10-% aqueous solution of polyvinyl alcohol . . . 20 parts
water . . . 60 parts <Preparation of Solution B (Color Developer Dispersion)>

A color developer dispersion was prepared by pulverization followed by dispersion of the following composition with a sand mill such that the average particle diameter was 0.5 μm.

4-isopropoxy-4'-hydroxyphenylsulfone . . . 20 parts
10-% aqueous solution of polyvinyl alcohol . . . 20 parts
Silica . . . 10 parts
water . . . 50 parts <Preparation of Solution C (Heat-Sensitive Coloring Layer Coating Solution)>

The following composition was mixed then stirred, and a heat-sensitive coloring layer coating solution was prepared.

solution A (leuco dye dispersion) . . . 20 parts
solution B (color developer dispersion) . . . 60 parts
water . . . 30 parts <Preparation of Solution D1 (Back Layer and Under Layer Coating Solution (i))>

The following composition was mixed and then stirred, and a back layer and under layer coating solution (i) was prepared.

40-% solution of acrylic ester copolymer (DICNAL RS-308 manufacture by Dai Nippon Ink And Chemical Industries Ltd.) . . . 10 parts
10-% aqueous solution of an itaconic acid modified polyvinyl alcohol . . . 5 parts
10-% solution of water dispersed silica . . . 30 parts
40-% solution of copolymer of methacryloyloxyethyltrimethylammonium chloride and styrene . . . 10 parts
water . . . 45 parts <Preparation of Solution D2 (Back Layer and Under Layer Coating Solution (ii))>

The following composition was mixed and then stirred, and a back layer and under layer coating solution (ii) was prepared.

10-% aqueous solution of polyvinyl alcohol . . . 20 parts
10-% solution of water dispersed silica . . . 10 parts
40-% solution of copolymer of methacryloyloxyethyltrimethylammonium chloride and styrene . . . 5 parts
25-% aqueous solution of polyamide epichlorohydrin resin . . . 5 parts
water . . . 60 parts.

<Preparation of Solution D3 (Back Layer and Under Layer Coating Solution (iii))>

The following composition was mixed and then stirred, and a back layer and under layer coating solution (iii) was prepared.

40-% solution of acrylic ester copolymer (DICNAL RS-308, manufactured by Dai Nippon Ink And Chemical Industries Ltd.) . . . 10 parts
10-% aqueous solution of itaconic acid modified polyvinyl alcohol . . . 5 parts
10-% solution of water dispersed silica . . . 30 parts
33-% solution of quaternary salt styrene polymer (CHEMISTAT 6300 manufactured by Sanyo Chemical Industries Ltd.) . . . 12 parts
water . . . 47 parts <Preparation of Solution E1 (Protective Layer Coating Solution (i))>

The following composition was mixed and then stirred, and a protective layer coating solution was prepared.

10-% aqueous solution of itaconic acid modified polyvinyl alcohol . . . 35 parts
10-% solution of water dispersed aluminum hydroxide . . . 15 parts
25-% aqueous solution of polyamide epichlorohydrin resin . . . 5 parts
water . . . 45 parts <Preparation of Solution E2 (Protective Layer Coating Solution (ii))>

10-% aqueous solution of diacetone modified polyvinyl alcohol . . . 35 parts
10-% solution of water dispersed aluminum hydroxide . . . 20 parts
10-% aqueous solution of adipic acid dihydrazide . . . 7 parts
water . . . 38 parts <Preparation of Solution F1 (Under Layer Coating Solution (i))>

The following composition was mixed and then stirred, and an under layer coating solution (i) was prepared.

micro-hollow particles of non-foaming plastic (hollow ratio: 90%;
average particle diameter: 3 μm) . . . 55 parts
styrene-butadiene copolymer latex (bulk density: 47.5%). . . 30 parts
40-% solution of copolymer of methacryloyloxyethyltrimethylammonium chloride and styrene . . . 5 parts
water . . . 10 parts <Preparation of Solution F2 (Under Layer Coating Solution (ii))>

The following composition was mixed and then stirred, and an under layer coating solution (ii) was prepared.

micro-hollow particles of non-foaming plastic (hollow ratio: 90%; average particle diameter: 3 μm) . . . 60 parts
styrene-butadiene copolymer latex (bulk density: 47.5%) . . . 30 parts
water . . . 10 parts

EXAMPLE 1

—Manufacturing of Heat-Sensitive Recording Material—

An under layer was provided by applying followed by drying the solution D1 on a polypropylene film (PEARL FILM P-4257 manufactured by Tbyobo Co., Ltd.) having a thickness of 85 μm such that the deposited amount of the solution D1 after drying was 1 g/m$^2$.

Next, the heat-sensitive coloring layer was formed by applying followed by drying the solution C on the under layer such that the deposited amount of the solution C after drying was 5 g/m$^2$.

Next, the protective layer was formed by applying followed by drying the solution E1 on the heat-sensitive coloring layer such that the amount upon deposition was 3 g/m$^2$.

Next, the back layer was formed by applying followed by drying the solution D1 on the surface of the polypropylene film that did not have the heat-sensitive coloring layer such that the deposited amount of the solution D1 after drying was 1.5 g/m$^2$. Thus, the heat-sensitive recording material in Example 1 was manufactured. The layer structure of the heat-sensitive recording material in Example 1 is shown in Table 1.

TABLE 1

| | Coating Solution | Amount Deposited After Drying |
|---|---|---|
| Protective layer | Solution E1 | 3 g/m$^2$ |
| Heat-sensitive coloring layer | Solution C | 5 g/m$^2$ |
| Under layer | Solution D1 | 1 g/m$^2$ |
| Polypropylene film (substrate) | — | — |
| Back layer | Solution D1 | 1.5 g/m$^2$ |

EXAMPLE 2

<Manufacturing of Heat-Sensitive Recording Material>

A heat-sensitive recording material in Example 2 was manufactured similarly to the heat-sensitive recording material in Example 1 except that the 40-% solution of the copolymer of methacryloyloxyethyltrimethylammonium chloride and styrene was replaced by 40-% solution of copolymer of acryloyloxyethyltrimethylammonium chloride.

EXAMPLE 3

<Manufacturing of Heat-Sensitive Recording Material>

A heat-sensitive recording material in Example 3 was manufactured similarly to the heat-sensitive recording material in Example 1 except that the under layer was not formed. The layer structure of the heat-sensitive recording material in Example 3 is shown in Table 2.

TABLE 2

| | Coating Solution | Amount Deposited After Drying |
|---|---|---|
| Protective layer | Solution E1 | 3 g/m$^2$ |
| Heat-sensitive coloring layer | Solution C | 5 g/m$^2$ |

TABLE 2-continued

| | Coating Solution | Amount Deposited After Drying |
|---|---|---|
| Polypropylene film (substrate) | — | — |
| Back layer | Solution D1 | 1.5 g/m$^2$ |

EXAMPLE 4

<Manufacturing of Heat-Sensitive Recording Material>

A heat-sensitive recording material in Example 4 was manufactured similarly to the heat-sensitive recording material in Example 1 except that the solution D1 was replaced by the solution D2. The layer structure of the heat-sensitive recording material in Example 4 is shown in Table 3.

TABLE 3

| | Coating Solution | Amount Deposited After Drying |
|---|---|---|
| Protective layer | Solution E1 | 3 g/m$^2$ |
| Heat-sensitive coloring layer | Solution C | 5 g/m$^2$ |
| Under layer | Solution D2 | 1 g/m$^2$ |
| Polypropylene film (substrate) | — | — |
| Back layer | Solution D2 | 1.5 g/m$^2$ |

EXAMPLE 5

<Manufacturing of Heat-Sensitive Recording Material>

A heat-sensitive recording material in Example 5 was manufactured similarly to the heat-sensitive recording material in Example 1 except that the solution D1 in the under layer was replaced by the solution F1 and that the deposited amount of the solution F1 after drying was changed to 2.5 g/m$^2$. The layer structure of the heat-sensitive recording material in Example 5 is shown in Table 4.

TABLE 4

| | Coating Solution | Amount Deposited Upon Drying |
|---|---|---|
| Protective layer | Solution E1 | 3 g/m$^2$ |
| Heat-sensitive coloring layer | Solution C | 5 g/m$^2$ |
| Under layer | Solution F1 | 2.5 g/m$^2$ |
| Polypropylene film (substrate) | — | — |
| Back layer | Solution D1 | 1.5 g/m$^2$ |

EXAMPLE 6

<Manufacturing of the Heat-Sensitive Recording Material>

A first under layer was provided by applying followed by drying the solution F2 on the polypropylene film (PEARL FILM P-4257 manufactured by Toyobo Co., Ltd) having a thickness of 85 μm such that the deposited amount of the solution F2 after drying was 2.5 g/m$^2$.

Next, a second under layer was formed by applying followed by drying the solution D1 on the first under layer such that the deposited amount of the solution D1 after drying was 1 g/m$^2$.

Next, a heat-sensitive coloring layer was formed by applying followed by drying the solution C on the second under layer such that the deposited amount of the solution C after drying was 5 g/m$^2$.

Next, a protective layer was formed by applying followed by drying the solution E1 on the heat-sensitive coloring layer such that the deposited amount of the solution E1 after drying was 3 g/m$^2$.

Next, a back layer was formed by applying followed by drying the solution D1 on the surface of the polypropylene film that did not have the heat-sensitive coloring layer such that the deposited amount of the solution D1 after drying was 1.5 g/m$^2$. Thus, the heat-sensitive recording material in Example 6 was manufactured. The layer structure of the heat-sensitive recording material in Example 6 is shown in Table 5.

TABLE 5

| | Coating Solution | Amount Deposited After Drying |
|---|---|---|
| Protective layer | Solution E1 | 3 g/m$^2$ |
| Heat-sensitive coloring layer | Solution C | 5 g/m$^2$ |
| Second under layer | Solution D1 | 1 g/m$^2$ |
| First under layer | Solution F2 | 2.5 g/m$^2$ |
| Polypropylene film (substrate) | — | — |
| Back layer | Solution D1 | 1.5 g/m$^2$ |

EXAMPLE 7

—Manufacturing of Heat-Sensitive Recording Material—

A heat-sensitive recording material in Example 7 was manufactured similarly to the heat-sensitive recording material in Example 1 except that five parts of 40-% solution of the copolymer of methacryloyloxyethyltrimethylammonium chloride and styrene was added while preparing the solution E1.

EXAMPLE 8

—Manufacturing of Heat-Sensitive Recording Material—

A heat-sensitive recording material in Example 8 was manufactured similarly to the heat-sensitive recording material in Example 1 except that the solution D1 for the back layer was replaced by the solution D3. The layer structure of the heat-sensitive recording material in Example 8 is shown in Table 6.

TABLE 6

| | Coating Solution | Amount Deposited Upon Drying |
|---|---|---|
| Protective layer | Solution E1 | 3 g/m$^2$ |
| Heat-sensitive coloring layer | Solution C | 5 g/m$^2$ |
| Under layer | Solution D1 | 1 g/m$^2$ |
| Polypropylene film (substrate) | — | — |
| Back layer | Solution D3 | 1.5 g/m$^2$ |

EXAMPLE 9

—Manufacturing of Heat-Sensitive Recording Material—

A heat-sensitive recording material in Example 9 was manufactured similarly to the heat-sensitive recording material in Example 1 except that the solution E1 was replaced by the solution E2. The layer structure of the heat-sensitive recording material in Example 9 is shown in Table 7.

TABLE 7

| | Coating Solution | Amount Deposited Upon Diying |
|---|---|---|
| Protective layer | Solution E2 | 3 g/m$^2$ |
| Heat-sensitive coloring layer | Solution C | 5 g/m$^2$ |
| Under layer | Solution D1 | 1 g/m$^2$ |
| Polypropylene film (substrate) | — | — |
| Back layer | Solution D1 | 1.5 g/m$^2$ |

COMPARATIVE EXAMPLE 1

<Manufacturing of Heat-Sensitive Recording Material>

A heat-sensitive recording material in Comparative Example 1 was manufactured similarly to the heat-sensitive recording material in Example 1 except that the solution D1 was replaced by the solution D3. The layer structure of the heat-sensitive recording material in Comparative Example 1 is shown in Table 8.

TABLE 8

| | Coating Solution | Amount Deposited Upon Drying |
|---|---|---|
| Protective layer | Solution E1 | 3 g/m$^2$ |
| Heat-sensitive coloring layer | Solution C | 5 g/m$^2$ |
| Under layer | Solution D3 | 1 g/m$^2$ |
| Polypropylene film (substrate) | — | — |
| Back layer | Solution D3 | 1.5 g/m$^2$ |

COMPARATIVE EXAMPLE 2

<Manufacturing Heat-Sensitive Recording Material>

A heat-sensitive recording material in Comparative Example 2 was manufactured similarly to the heat-sensitive recording material in Comparative Example 1 except that a 30-% solution of ammonium polystyrene sulfonate (CHEMISTAT SA-101 manufactured by Sanyo Chemical Industries Ltd.) was used instead of the 33-% solution of quaternary styrene polymer while preparing the solution D3.

COMPARATIVE EXAMPLE 3

<Manufacturing Heat-Sensitive Recording Material>

A heat-sensitive recording material in Comparative Example 3 was manufactured similarly to the heat-sensitive recording material in Example 1 except that the 40-% solution of the copolymer of methacryloyloxyethyltrimethylammonium chloride and styrene was excluded from the solution D1.

Next, various properties of the heat-sensitive recording materials obtained in Example 1 to Example 9 and in Comparative Example 1 to Comparative Example 3 were evaluated as follows. The results are shown in Table 9.

<Coloring Property>

Printing was performed on each of the heat-sensitive recording materials by a print simulator manufactured by Okura Electric Co., Ltd. with a pulse width ranging from 0.2 ms to 1.2 ms under the following conditions: head electric power: 0.45 w/dot; recording time per line: 20 ms/l; and scanning density: 8×3.85 dots/mm. The print density and the density of the base surface at 0.4 ms, 0.6 ms, and 1.0 ms were measured by a MACBETH REFLECTION DENSITOMETER RD-914.

<70-° C. Image-Color Degradation Resistance Property>

The heat-sensitive recording material was kept in a dry environment with a temperature of 70° C. for 15 hours, and then the density of a print portion was measured by a MACBETH REFLECTION DENSITOMETER RD-914. The result was evaluated based on the following criteria.

[Evaluation Criteria]

A: print density of 1.30 or more

B: print density of 1.15 or more and less than 1.30

C: print density of less than 1.15

<Water Resistance>

After soaking each of the heat-sensitive recording materials in water for 15 hours in an environment of 20° C., the front surface and the rear surface were rubbed ten times with a finger, and exfoliation of the coating layer was checked visually.

A . . . coating layer was not exfoliated

B . . . coating layer was exfoliated (with resistance)

C . . . coating layer was exfoliated (with no resistance)

<Surface Resistance>

The surface resistance of the front surface and the rear surface of each of the heat-sensitive recording material was measured by using a HIGH RESISTANCE METER (4339A manufactured by Hewlett-Packard Japan, Ltd.)

<Low-Humidity Feeding Property>

Printing was performed with a printer 1-4308, manufactured by Datamax Co., Ltd., at a temperature of 10° C. and a relative humidity of 15%, and feeding was checked.

A . . . fed normally (feeding was normal)

B . . . not fed (feeding was not proper)

TABLE 9

| | Coloring Property | | | 70-° C. Image Color Degradation Resistance | | Water | Surface Resistance (Ω) | | Low-Temperature |
|---|---|---|---|---|---|---|---|---|---|
| | 0.4 ms | 0.6 ms | 1.0 ms | Print Density | Evaluation | Resistance | Front Surface | Rear Surface | Feeding Property |
| Example 1 | 0.57 | 1.28 | 1.37 | 1.31 | A | A | $3 \times 10^{10}$ | $5 \times 10^{8}$ | A |
| Example 2 | 0.56 | 1.27 | 1.37 | 1.30 | A | A | $2 \times 10^{10}$ | $3 \times 10^{8}$ | A |
| Example 3 | 0.58 | 1.30 | 1.37 | 1.33 | A | A | $2 \times 10^{11}$ | $5 \times 10^{8}$ | A |
| Example 4 | 0.57 | 1.27 | 1.37 | 1.32 | A | A | $2 \times 10^{11}$ | $6 \times 10^{8}$ | A |
| Example 5 | 0.68 | 1.35 | 1.37 | 1.32 | A | A | $5 \times 10^{10}$ | $5 \times 10^{8}$ | A |
| Example 6 | 0.63 | 1.34 | 1.37 | 1.32 | A | A | $4 \times 10^{10}$ | $5 \times 10^{8}$ | A |
| Example 7 | 0.54 | 1.25 | 1.36 | 1.29 | B | A | $5 \times 10^{9}$ | $4 \times 10^{8}$ | A |
| Example 8 | 0.57 | 1.27 | 1.37 | 1.31 | A | A | $5 \times 10^{10}$ | ∞ | A |
| Example 9 | 0.55 | 1.27 | 1.37 | 1.29 | B | A | $9 \times 10^{9}$ | $4 \times 10^{8}$ | A |
| Comparative Example 1 | 0.55 | 1.26 | 1.37 | 1.10 | C | A | $1 \times 10^{10}$ | $2 \times 10^{8}$ | A |
| Comparative Example 2 | 0.59 | 1.29 | 1.37 | 1.29 | B | C | $4 \times 10^{10}$ | $7 \times 10^{8}$ | A |
| Comparative Example 3 | 0.59 | 1.30 | 1.37 | 1.34 | A | A | ∞ | ∞ | B |

What is claimed is:

1. A heat-sensitive recording material comprising on one surface of a substrate a heat-sensitive coloring layer comprising a leuco dye and a color developer, wherein the heat-sensitive recording material comprises a layer which comprises a copolymer of a (meth)acryloyloxyalkylammonium salt and styrene.

2. The heat-sensitive recording material according to claim 1, wherein the (meth)acryloyloxyalkylammonium salt is (meth)alkyloyloxyethyltrimethylammonium chloride.

3. The heat-sensitive recording material according to claim 1, wherein the copolymer of the (meth)acryloyloxyalkylammonium salt and styrene is represented by General Formula (1):

General Formula (1)

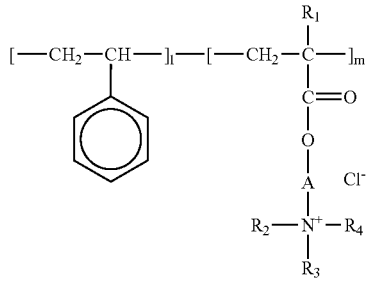

wherein $R_1$ represents any one of hydrogen atom and $CH_3$; $R_2$, $R_3$ and $R_4$ may be mutually identical or may be different, and represent any one of $CH_3$ and $C_2H_5$; A represents —$(CH_2)_n$— where n is any number from one to three; each of l and m represents an integer from one to 100.

4. The heat-sensitive recording material according to claim 1, wherein a content of the copolymer of the (meth)acryloyloxyalkylammonium salt and styrene in the layer comprising the copolymer is in a range of 5% by mass to 40% by mass.

5. The heat-sensitive recording material according to claim 1, wherein the layer comprising the copolymer of the (meth) acryloyloxyalkylammonium salt and styrene is at least any one of: a back layer on the surface of the substrate opposite to the side comprising the heat-sensitive coloring layer; an under layer between the substrate and the heat-sensitive coloring layer; and a protective layer on the heat-sensitive coloring layer.

6. The heat-sensitive recording material according to claim 5, wherein the layers which comprise the copolymer of the (meth)acryloyloxyalkylammonium salt and styrene are the back layer, the under layer and the protective layer.

7. The heat-sensitive recording material according to claim 5, wherein the back layer and the under layer comprise a binder resin, and the binder resin is one of a water dispersible resin and a water soluble resin.

8. The heat-sensitive recording material according to claim 7, wherein the binder resin comprises an acrylic ester copolymer.

9. The heat-sensitive recording material according to claim 5, wherein the under layer comprises plastic hollow particles having a hollow ratio of 50% or more.

10. The heat-sensitive recording material according to claim 5, wherein the protective layer comprises a binder resin, a cross-linking agent and a filler.

11. The heat-sensitive recording material according to claim 10, wherein the binder resin is an itaconic acid modified polyvinyl alcohol, and the cross-linking agent is a polyamide epichlorohydrin resin.

12. The heat-sensitive recording material according to claim 10, wherein the binder resin is a diacetone modified polyvinyl alcohol, and the cross-linking agent is an adipic acid dihydrazide.

13. The heat-sensitive recording material according to claim 5, wherein the layer comprising the copolymer of the (meth)acryloyloxyalkylammonium salt and styrene is at least one of the back layer and the under layer.

14. The heat-sensitive recording material according to claim 1, wherein the substrate is one of a plastic film and synthetic paper.

15. The heat-sensitive recording material according to claim 1, wherein the heat-sensitive recording material is a heat-sensitive recording label which comprises: an adhesive layer on the rear surface of the substrate opposite to the heat-sensitive coloring layer, and release paper on the adhesive layer.

16. The heat-sensitive recording material according to claim 1, wherein the heat-sensitive recording material is a heat-sensitive recording label comprising a heat-sensitive adhesive layer, which develops adhesion when heated, on the rear surface of the substrate on the side opposite to the heat-sensitive coloring layer.

17. The heat-sensitive recording material according to claim 1, wherein the heat-sensitive recording material is a heat-sensitive recording magnetic paper comprising a magnetic recording layer on the rear surface of the substrate on the side opposite to the heat-sensitive coloring layer.

18. The heat-sensitive recording material according to claim 1, wherein the heat-sensitive recording material is in a form of any one of a label, a sheet and a roll.

* * * * *